United States Patent [19]

Reichert

[11] 4,247,117

[45] Jan. 27, 1981

[54] TORSO TETHERED TRAINING DEVICE

[75] Inventor: Paul W. Reichert, Phoenix, Ariz.

[73] Assignee: Zeppa, Inc., Phoenix, Ariz.

[21] Appl. No.: 960,480

[22] Filed: Nov. 13, 1978

[51] Int. Cl.[3] ..... A63B 69/26

[52] U.S. Cl. ..... 273/411; 273/58 C

[58] Field of Search ..... 273/1 D, 55 B, 58 C, 273/95 A, DIG. 19, 411, 414; 272/76, 77, 78

[56] References Cited

U.S. PATENT DOCUMENTS 708,573 9/1902 Miles ..... 273/58 C UX 3,709,491 1/1973 Minchin ..... 273/58 C 4,121,822 10/1978 DiSabatino et al. ..... 273/DIG. 19

FOREIGN PATENT DOCUMENTS 728643 4/1932 France ..... 272/78

*Primary Examiner*—Anton O. Oechsle

*Attorney, Agent, or Firm*—Cahill, Sutton & Thomas

[57] ABSTRACT

A torso mounted harness supports a vertically adjustably located anchor for an elastic cord attached to a ball encapsulating harness whereby the return trajectory of the encapsulated ball is biasable to different heights.

4 Claims, 4 Drawing Figures fig. 1
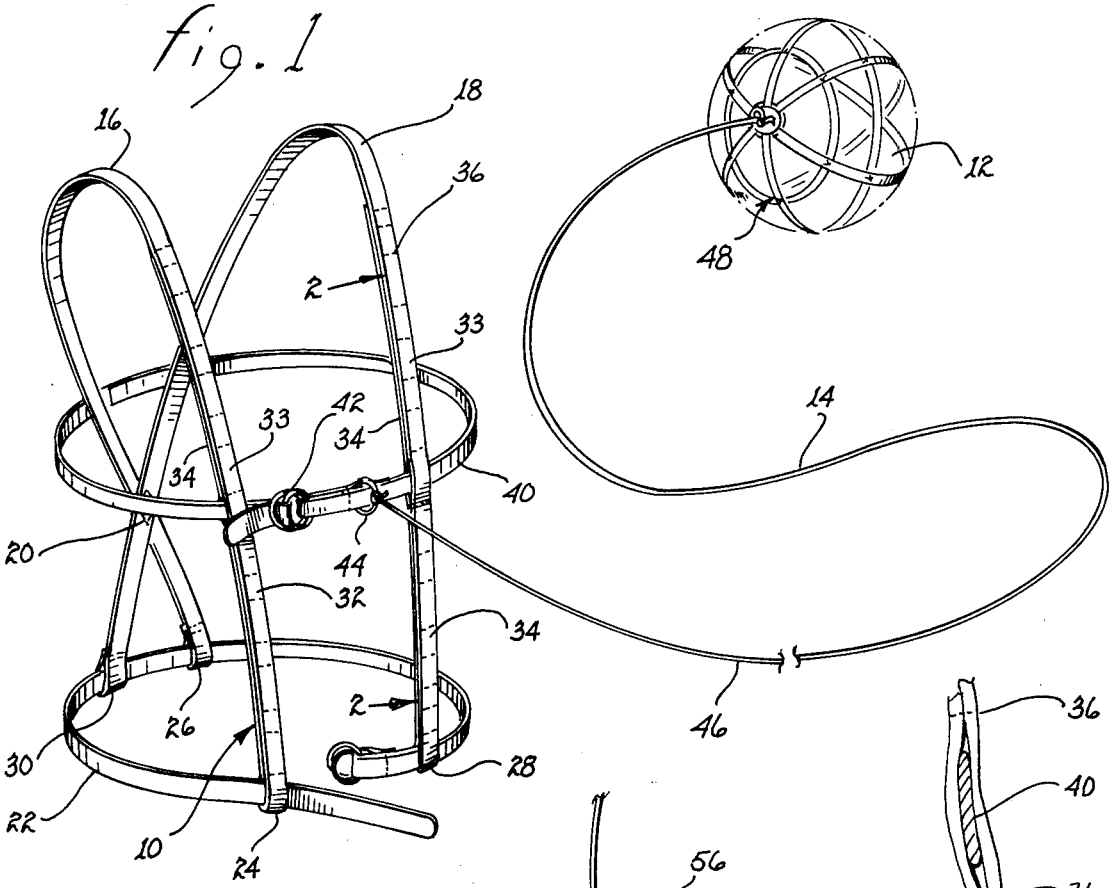
fig. 3
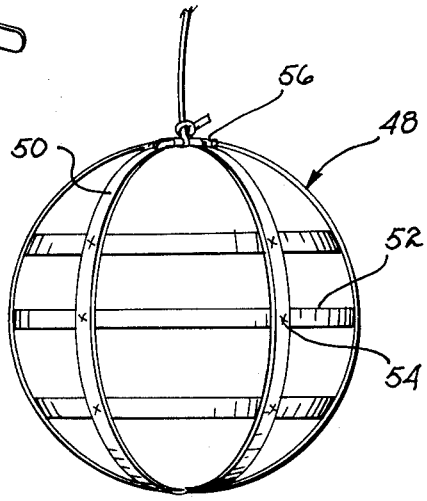
fig. 4
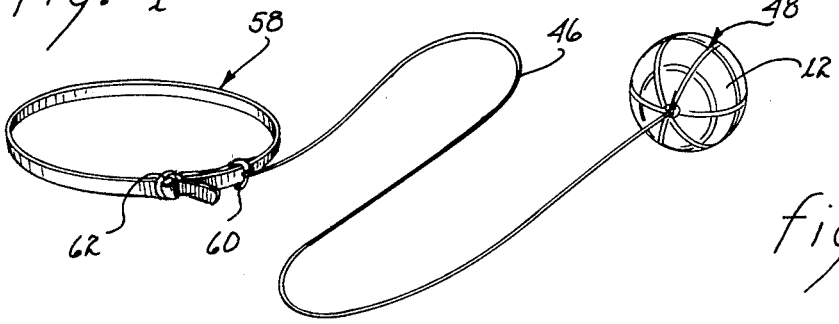
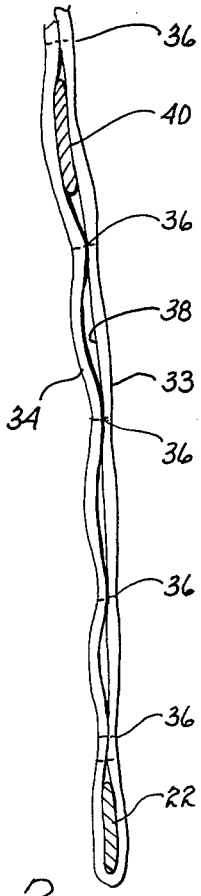
fig. 2

TORSO TETHERED TRAINING DEVICE

The present invention relates to training devices and, more particularly, to balls tethered to a trainee.

To be proficient in any sport, many hours must be spent in training. Where the sport involves the moving of a ball from one point to another, either by a part of the athlete's body or by means of an implement, skills must be honed to accurately move the ball a given distance in a given direction and along a given trajectory. When an athlete must practice alone, retrieval of the ball is tedious and wasteful of time. Consequently, many different types of apparatus have been developed which tether a ball useable in practicing a sport and thereby eliminate or at least reduce retrieval of the ball.

In U.S. Pat. No. 667,563, there is shown an elastic cord having one end internally anchored to a specially constructed baseball-like ball and the other end of the cord is attached to a wrist band. U.S. Pat. No. 3,940,133, is directed to a specially constructed football-like anchored through a rubberband to a user's wrist. U.S. Pat. No. 4,021,035 illustrates an inflatable ball attached by means of a short line to a belt whereby the wearer can exercise by bouncing the ball off his knee, chest, hips, etc. U.S. Pat. No. 4,042,241 shows an inflatable ball operatively attached to the internal passageway in one end of an elastic air hose, which hose is employed to inflate the ball; the other end of the air hose includes an opening for inflating the ball and a loop for engaging the hose to the leg or head of a user. U.S. Pat. No. 4,071,241, is directed to a tethered soccer ball slidably mounted within a sleeve disposed partially about the waist of a user to permit the user to continuously vary the length of the tether. U.S. Pat. Nos. 3,820,783 and 4,059,271 are directed to body mountable apparatus supporting tethered balls cooperative with the apparatus.

In games such as volleyball, soccer of kickball, much of the ball handling is performed by intercepting and redirecting a pass with the player's head, chest, arms, hands or feet. It is very difficult for a player to practice these moves by himself unless he lobs or kicks the ball almost straight up in the air; even if he does, the resulting downward trajectory of the ball is essentially vertical and little practice is achieved for redirecting a ball with a trajectory which has a substantial horizontal component.

Accordingly, it is a primary object of the present invention to provide a training device which tends to return a ball along an above-ground trajectory.

Another object of the present invention is to provide a training aid for volleyball and soccer players to head a ball.

Yet another object of the present invention is to provide a training aid for volleyball and soccer players to redirect an airborne ball with their chest.

Still another object of the present invention is to provide a training aid which can bias the return trajectory of a ball along vertically adjustable paths.

A further object of the present invention is to provide a harness for tethering any readily available ball to a person.

A yet further object of the present invention is to provide an inexpensive harness for tethering a ball to a person.

A still further object of the present invention is to provide a smooth surfaced harness for encapsulating a ball tethered to a person's body and eliminating injury which otherwise might result from a harness having protrusions radially oriented to the ball or anchors attached to the ball.

These and other objects of the present invention will become apparent to those skilled in the art as the description thereof proceeds.

The present invention may be described with greater specificity and clarity with reference to the following drawings, in which:

FIG. 1 is a perspective view illustrating the training aid;

FIG. 2 is a cross-sectional view taken along lines 2—2, as shown in FIG. 1;

FIG. 3 is a side elevational view of the harness for encapsulating a ball; and FIG. 4 illustrates a variant of the training device.

Referring to FIG. 1, there is illustrated a torso mounted harness 10 for anchoring a tethered ball 12 through an elastic cord 14. The harness includes a pair of shoulder straps 16 and 18 attached to one another at cross point 20. An adjustable belt 22 is penetratingly attached to loops 24, 26, 28 and 30 of shoulder straps 16 and 18, respectively.

Front sections 32 and 34 of shoulder straps 16 and 18 include a double layer of webbing 33, 35, respectively, which layers are attached to one another at new lines 36 to form a series of slots 38, as shown in detail in FIG. 2. These slots may be disposed along the substantial length of front sections 32 and 34, such as from belt 22 to the apex of the shoulder straps. Each of the slots is configured to penetrably receive a chest belt 40, as shown in FIG. 1. Thereby, chest belt 40 may be vertically positioned from a point close to belt 22 to a point near the apex of the shoulder straps, depending upon which pairs of slots in the front sections are engaged. A conventional buckle 42 is employed to permit repositioning of the belt along the shoulder straps and tightening of the belt to conform with the chest size of the user.

A ring 44 is attached to the chest belt in proximity to buckle 42 to serve as an anchor for one end of elastic cord 46. The other end of the elastic cord is secured to a harness 48 for encapsulating ball 12 therein, as particularly shown in FIG. 3.

Harness 48 is developed from a plurality of longitudinally oriented bands 48 supportingly attached to a plurality of laterally oriented bands 50 at cross points 52. These bands are relatively thin smooth surfaced bands to minimize radial protrusion from the surface of ball 12. By maintaining the radial protrusion very slight, ridges of any import on the surface of the ball will not be present. Such ridges, if present, could be a potential source of injury to a user were he to practice intercepting the ball with his chest, head or other parts of the user's body.

The attachment of cord 46 to harness 48 may be by knotting it to engage a loop 56 disposed at the apex of longitudinal bands 50.

For certain types of training, it may be unnecessary to vary the vertical height of the anchor point of cord 46 to harness 10. For such training, a belt 58, as shown in FIG. 4, may be employed. Herein, the belt, through a supported ring 60, anchors cord 46 and ball 12 encapsulated within harness 48. A conventional double ring buckle 62 may be employed to permit rapid attachment and detachment of the belt.

In operation, an athlete, such as a volleyball or soccer player, who wished to train himself to use his head or chest to intercept a soccer ball traveling along a trajectory having a substantial horizontal component, would strap harness 10 onto himself. By locating belt 40 within one of the pairs of loops 38 in shoulder straps 16 and 18, he can adjustably bias the vertical height of the trajectory of a ball drawn to him through contraction of cord 46. Thus, the athlete can readily practice the interception of a ball returning along various trajectories, which trajectories have substantial horizontal components commensurate with that of normal play. Moreover, he can practice intercepting the ball with his head, chest or legs and various points thereon with great facility and with no risk of injury from the ball encapsulating harness. Other training exercises such as dribbling, spiking, feinting and kicking can also be readily carried out.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A training device for urging a tethered ball to have a return trajectory directed toward an athlete's torso, said device comprising in combination:

(a) a torso mounted harness for anchoring the tethered ball to the athlete's torso, said harness including:

i. a pair of shoulder straps, each said shoulder strap including a front section;

ii. a plurality of slots disposed in each said front section; and iii. a chest belt for penetrating engagement with one of said slots in each said front section to position and retain said chest belt at a predetermined height on the athlete's torso, said chest belt including ring means for attaching the tethered ball, whereby, the height of said chest belt is variably positioned in height upon the athlete's torso;

(b) an elastic cord having one end thereof attachable to said ring means; and (c) means for encapsulating the ball, said encapsulating means including loop means for engaging the other end of said elastic cord;

whereby, a return trajectory of the ball under the force urged by contraction of said cord is directed toward the anchor point on the athlete's torso.

2. The training device as set forth in claim 1 wherein said encapsulating means comprises a plurality of longitudinally oriented bands and a plurality of laterally oriented bands, said longitudinally oriented bands being affixed to said laterally oriented bands at the intersections therebetween.

3. The training device as set forth in claim 2 wherein said loop means is disposed at an apex of said longitudinally oriented bands.

4. The training device as set forth in claim 3 wherein said longitudinally oriented bands and said laterally oriented bands are flat bands.

* * * * *